US009222175B2

(12) United States Patent
Zamanzadeh et al.

(10) Patent No.: US 9,222,175 B2
(45) Date of Patent: Dec. 29, 2015

(54) METHOD FOR PROTECTING ELECTRICAL POLES AND GALVANIZED ANCHORS FROM GALVANIC CORROSION

(75) Inventors: Mehrooz Zamanzadeh, Presto, PA (US); Geoffrey O. Rhodes, Saxonburg, PA (US)

(73) Assignee: MATCO SERVICES, INC., Pittsburgh, PA (US)

( * ) Notice: Subject to any disclaimer, the term of this patent is extended or adjusted under 35 U.S.C. 154(b) by 410 days.

(21) Appl. No.: 13/296,357

(22) Filed: Nov. 15, 2011

(65) Prior Publication Data

US 2012/0298525 A1 Nov. 29, 2012

Related U.S. Application Data

(60) Provisional application No. 61/414,144, filed on Nov. 16, 2010, provisional application No. 61/537,640, filed on Sep. 22, 2011.

(51) Int. Cl.

| | |
|---|---|
| ***C23F 13/00*** | (2006.01) |
| ***C23F 13/20*** | (2006.01) |
| ***C23F 13/04*** | (2006.01) |
| ***H01R 4/66*** | (2006.01) |

(52) U.S. Cl.

CPC ..... *C23F 13/20* (2013.01); *C23F 13/04* (2013.01); *H01R 4/66* (2013.01); *C23F 2213/31* (2013.01)

(58) Field of Classification Search

CPC ..... C23F 13/00; C23F 13/005; C23F 13/02–13/22; C23F 2213/30–2213/32; H02B 5/00–7/08

USPC ..... 205/724, 725, 727, 728, 729; 204/196.01, 196.02, 196.04, 196.05, 204/196.09, 196.1, 196.21, 196.36; 307/326, 327

See application file for complete search history.

(56) References Cited

U.S. PATENT DOCUMENTS

| | | | | |
|---|---|---|---|---|
| 989,596 | A | 4/1911 | Geppert | |
| 1,055,327 | A | 3/1913 | Hering | |
| 1,671,173 | A | 5/1928 | Von Wurstemberger | |
| 4,784,823 | A | 11/1988 | Holtmann et al. | |
| 5,026,468 | A | 6/1991 | Carpenter | |
| 5,321,318 | A | 6/1994 | Montreuil | |
| RE38,581 | E * | 9/2004 | Doniguian | 205/724 |
| 7,027,957 | B2 * | 4/2006 | Fourie et al. | 702/188 |
| 7,186,321 | B2 | 3/2007 | Benham | |
| 7,468,879 | B2 | 12/2008 | Rizk et al. | |
| 7,520,974 | B2 * | 4/2009 | Whitmore | 205/734 |
| 7,909,982 | B2 * | 3/2011 | Glass et al. | 205/734 |
| 2002/0008042 | A1 * | 1/2002 | Pierro et al. | 205/777.5 |
| 2005/0257946 | A1 | 11/2005 | Kirby et al. | |
| 2008/0105562 | A1 * | 5/2008 | Simpson et al. | 205/724 |

OTHER PUBLICATIONS

Lawson (IEEE Transactions on Industry Applications, vol. 24, No. 1, Jan./Feb. 1988, pp. 25-32).*
Aspen Environmental Group (2009, pp. 1-2).*
Devarakonda et al. (Transmission and Distribution Conference and Exposition, IEEE PES, Apr. 2010).*
Iranian Ministry of Petroleum. "Engineering Standard for Cathodic Protection" IPS-E-TP-820, Jan. 2005.

* cited by examiner

*Primary Examiner* — Luan Van
*Assistant Examiner* — Alexander W Keeling
(74) *Attorney, Agent, or Firm* — David H. Milligan

(57) ABSTRACT

A method for protecting a plurality of metal electrical poles and copper grounding from galvanic corrosion in corrosive soils includes electrically interconnecting the poles to a grounding grid and providing an impressed current anode for the cathodic protection of the grounding grid.

9 Claims, 4 Drawing Sheets

METHOD FOR PROTECTING ELECTRICAL POLES AND GALVANIZED ANCHORS FROM GALVANIC CORROSION

This application claims priority from U.S. Provisional Application Ser. No. 61/414,144 filed Nov. 16, 2010 and from U.S. Provisional Application Ser. No. 61/537,640 filed Sep. 22, 2011

BACKGROUND

The present invention relates to a method of protecting electrical poles, towers, copper grounding, and galvanized anchors from accelerated corrosion in corrosive soils.

SUMMARY

The present invention recognizes that the grounding grid of an electrical substation, having a more electropositive native potential (−200 mV) than the native potential of the galvanized steel poles near the substation (−1,100 mV), creates a galvanic corrosion cell which results in accelerated corrosion of the galvanized steel poles. To counter this condition, anodes are installed adjacent the grounding grid, and an impressed current is established so as to shift the effective potential (the Instant Off potential) of the grounding grid to approximately −1050 mV. With that impressed current being applied to the grounding grid, the metal poles no longer "see" the grounding grid as a large electropositive cathode, which eliminates the driving force for galvanic corrosion of the poles and thereby protects the poles against corrosion.

DESCRIPTION

Figure 1:
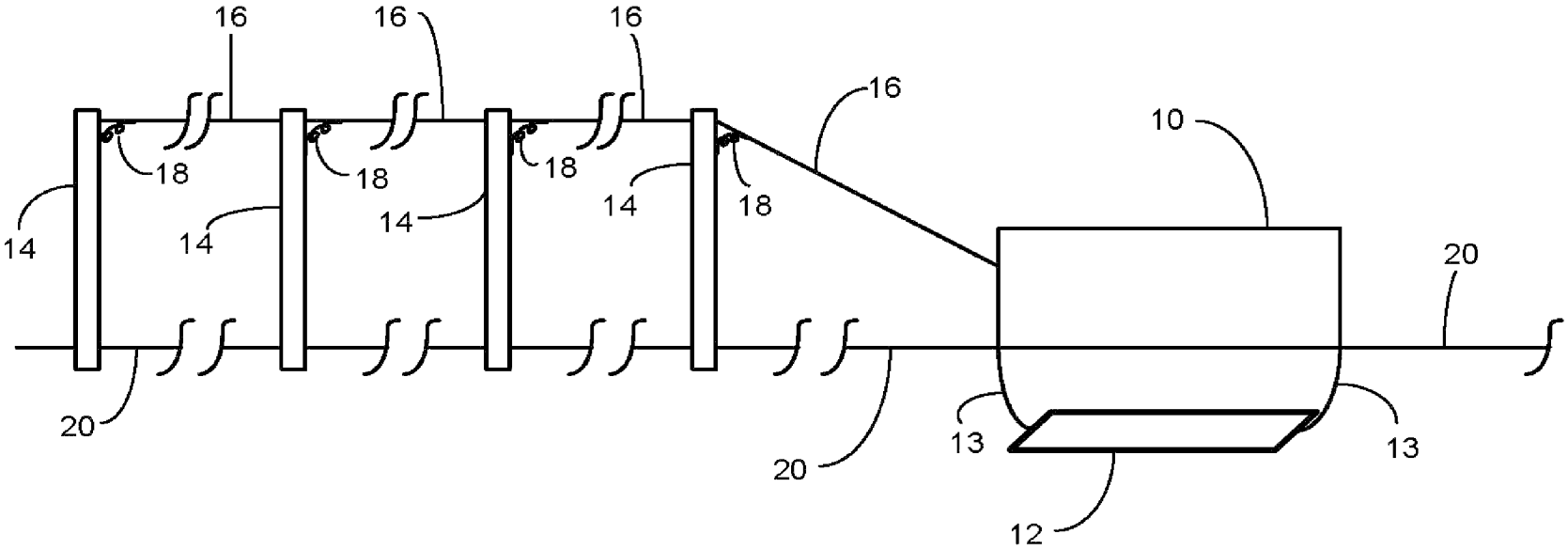
Fig 1 Prior Art
FIG. 1 is a schematic side view, partially broken away, of an existing prior art installation of power poles (and towers) and a substation with a copper grounding grid.

FIG. 1 shows a prior art electrical substation 10, which includes a large, underground copper grounding grid 12 beneath the substation 10.

In a typical prior art electrical substation, a ground wire 16 extends from the substation 10 to the nearest electrical pole 14 and then from one electrical pole 14 to the next, and each of the electrical poles 14 in the series is electrically connected to this ground wire 16 via a wire pigtail 18. (It should be noted that the electrical poles 14 in the drawing may represent utility poles or towers, and the use of the word "pole" in this description also encompasses towers.) The ground wire 16, which may also be a neutral return or shield wire as needed for the electrical circuit or lightning protection, is electrically connected to (that is, it is in electrical continuity with) the substation 10, which, in turn, is electrically connected to the copper grounding grid 12 via the bonding wires 13. Each power pole 14 is also firmly planted into the ground (soil 20).

The present invention includes the realization that this arrangement results in a galvanic corrosion cell that accelerates the corrosion of the poles and of any metal anchors connected to the poles, because the poles 14, whether or not they are galvanized, have a much more electronegative native potential than the copper grounding grid 12 of the substation 10. The ground wire 16 from the poles 14 to the substation 10 and the grounding wires 13 from the substation 10 to the grounding grid 12 provide an electrical pathway (electrical continuity) from each pole 14 to the copper grounding grid 12, and the earth 20 itself provides an ion pathway so as to complete the electrochemical circuit. The power poles 14 (and any metal anchors connected to the poles 14) effectively "see" the copper grounding grid 12 of the substation as being a cathode, having a more electropositive potential than the poles 14 (and anchors), and the poles 14 (and anchors) then become the anodes of this corrosion cell. This means that the poles 14 (and anchors) lose electrons and corrode. Thus, the connection of the poles 14 (and anchors) to the substation 10 and to its copper grounding grid 12 causes accelerated corrosion of the power poles 14 (and anchors) due to galvanic action.

The native ground potential of the copper grounding grid 12 typically is approximately −200 millivolts (mV), while the native ground potential for zinc galvanized steel poles typically is from −700 to −1100 mV, depending on the specific intermetallic layer present. When the grounding grid 12 and poles 14 are made electrically common by bonding via the pigtails 18, wire 16, substation 10, and bonding wires 13, a mixed-metal potential of about −650 mV, which is calculated as the mathematical average:

$$(-1{,}100+(-200))/2=-650\text{ mV}$$

results on all electrically common structures. This potential may vary depending upon soil corrosion characteristics. This large difference in potential sets up the galvanic cell, resulting in accelerated corrosion of the galvanized steel poles 14, with the more electronegative metal (the galvanized poles 14 and anchors at −1,100 mV native potential) behaving as the anode and the more electropositive metal (the grounding grid 12 at −200 mV native potential) behaving as the cathode.

Of course, this is an unintended consequence of grounding the poles 14 through the substation 10 to the copper grounding grid 12 in corrosive soils.

Figure 2:
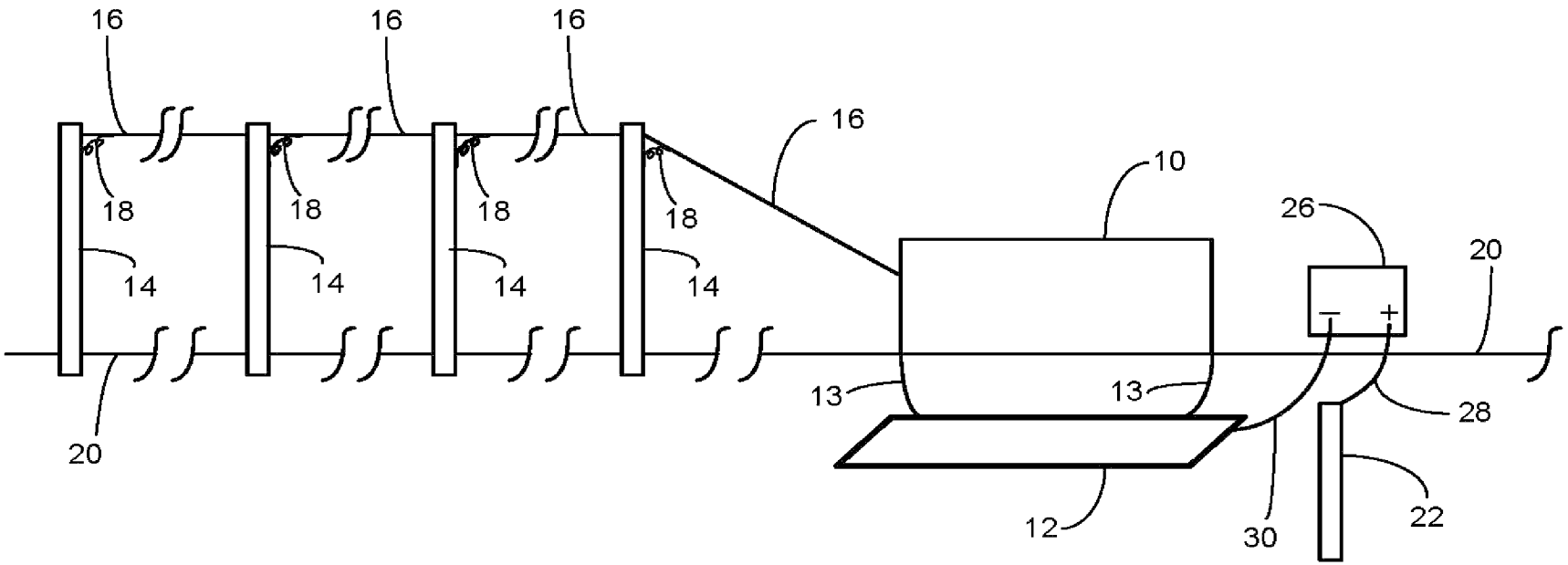
FIG. 2 is a schematic side view, similar to FIG. 1, but with an impressed current cathodic protection system being applied in accordance with the present invention.
Figure 3:
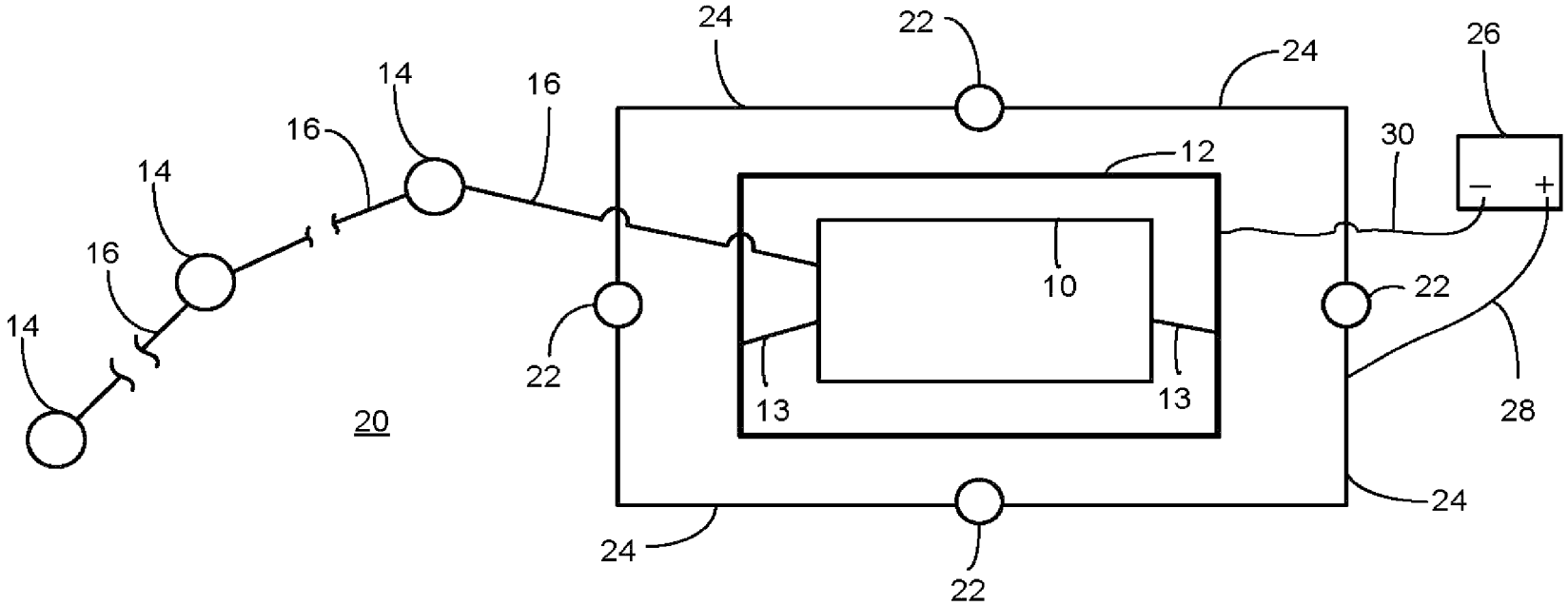
FIG. 3 is a schematic plan view of the installation of FIG. 2.

FIGS. 2 and 3 schematically depict the solution which is the subject of this invention. As best appreciated in FIG. 3, impressed current anodes 22 are placed around the grounding grid 12 to surround the grounding grid 12. In this particular embodiment, the impressed current anodes 22 are placed on the North, South, East and West sides of the grounding grid 12, at approximately the midpoint of each side of the grid 12, and at a distance of about ten feet outside of the grid. In this embodiment, four anodes placed in the cardinal directions (N-S-E-W) around the grounding grid and placed at a distance of L/3.5 (with L being the length of a given side of the grid) is appropriate. In other cases, using a greater number of anodes may be desired to minimize the distance of the anodes from the grid or due to the calculated current output from the individual anode(s). Alternatively, continuous linear anodes may at times be desirable—these would be plowed in or trenched in adjacent to the grounding grid. There is no reason in theory why the anodes could not be placed inside the grounding grid, except in practicality, if the substation is located there, it would require too much disturbance of existing assets to install or repair. The impressed current anodes may be made of any suitable material. Commonly used materials for impressed current anodes include graphite, cast silicon-iron or mixed metal oxide wires. Numerous types are commercially available.

These anodes 22 are electrically connected to each other via an electrical wire 24, which, in turn, is electrically connected via an electrical wire 28 to the positive (+) terminal of a direct current (DC) power source 26, which in this case is a cathodic protection rectifier 26. Another electrical wire 30 connects the negative (−) terminal of the DC power source 26 to the grounding grid 12.

Using this arrangement, an impressed current is applied to the grounding grid 12 by the DC rectifier 26 to lower the electrochemical potential of the grid 12. In this instance, an impressed current resulting in an IR free polarized potential of approximately −850 to −1050 mV instant-off potential is applied, as measured at the grounding grid 12. This instant-off potential approximates but is slightly less negative than the native potential of the galvanized steel poles 14. (If a potential were applied that was more negative than the −1100 mV potential of the poles 14, it might cause a shift in pH of the soil, which could cause accelerated corrosion of the galvanized coating on the poles 14.) This impressed current effectively reduces the potential of the grid 12 as "seen" by the galvanized poles 14 nearly back to the native potential of the poles 14. This means that there is no longer a galvanic corrosion cell driving force between the poles 14 and the grounding grid 12, so the grounding grid 12 no longer causes accelerated corrosion of the poles 14.

The standard Instant-Off potential is measured with respect to a copper-copper sulfate reference cell. The Instant-Off measurement is captured when the Cathodic Protection current (CP current) is interrupted, and the IR drop in the soil disappears to reveal a CP potential plateau (lasting up to half a second) that best approximates the polarization between the structure and the contacting soil. In this case, the structure is the grounding grid 12.

To attain the desired level of impressed current at the grounding grid 12, the rectifier 26 is energized, and the voltage and amperage outputs are adjusted until the instant off reading at the grounding grid 12 is the desired reading. Instant off potential is the same as an IR free potential (where V=IR stands for Voltage=Current (I)×Resistance (R)), and the IR portion is the potential contribution which may be measured as the Cathodic Protection current flowing between the reference cell (placed atop the soil) and the structure.

It should be noted that this arrangement also provides protection to the copper grounding grid 12 which is susceptible to accelerated corrosion in corrosive soils due to the galvanic cell that has been created with the poles 14.

While there may be variations in the protocol to establish the desired degree of protection of the grounding grid 12 and the poles 14, a typical protocol is outlined below:

1—Identify contiguous substations to be tested and modified (these are all the substations 10 between sets of poles 14 to be protected, wherein the poles 14 are in electrical continuity with the substations 10).

2—Measure soil resistivity around each substation 10 and use this information to determine anode locations and rectifier voltage requirements for that substation 10. Advantageously place anodes 22 around each grid 12 and in the lowest resistivity soil for the least required voltage of the rectifier 26.

3—Measure the native potential of the copper grounding grid 12 at each substation 10.

4—Measure the native potential of selected galvanized poles 14 between the substations 10. The selection can be a random distribution of the poles 14, or all poles 14 may be measured, if desired.

5—Establish the current to be used at the rectifier 26 for each substation 10. As a first iteration, this current may be calculated as 4 mA per square foot surface area of bare copper wire in the grounding grid 12 of the corresponding substation 10. Apply the respective impressed current (IC) cathodic protection system at each respective substation 10, connecting the positive terminal of each respective rectifier 26 to the respective anodes 22 and the negative terminal to the grounding grid 12 at that substation 10, with each respective substation 10 having a set-up as shown in FIG. 3.

6—Take a series of readings at a plurality of different points around the grounding grid. The readings include the native potential (NP), the "ON" potential, and the "Instant OFF" potential.

7—Calculate a polarization for each point, wherein:

Polarization(P)="Instant OFF" potential−Native Potential

8—Calculate an average polarization (AP), wherein:

Average Polarization(AP)=Average Native Potential−Average "OFF" potential

9—The AP figure above is the polarization reached when the first iteration current (see item 4 above) is applied at the rectifier 26.

10—The desired polarization of the grounding grid 12 at the substation 10 should be on the order of −1050 mV for poles having a native potential of −1100 mV, so now the desired shift in polarization to achieve this desired polarization is calculated.

the desired shift of the grid=the desired polarization of the grid−the Average Native Polarization of the grid 11—Using a simple ratio, the required current to achieve the desired shift is calculated, wherein:

AP/actual current in $1^{st}$ iteration=desired shift in polarization/$X$ wherein X=the required current to achieve the desired shift in polarization.

EXAMPLE

In an actual field test, the initial current used at the rectifier at substation A was 1.8 amps. The average native potential was measured (averaging the observed native potential at a plurality of points around the grid 12 of substation A) as 542 mV, and the average "Instant Off" potential was measured (averaging the observed Instant Off potentials) as 729 mV.

The average polarization (AP) was then calculated:

AP=average "Instant OFF" potential−average Native Potential

AP=729−542=187 mV

The desired shift was then calculated:

Desired shift=desired polarization−average native polarization

Desired shift=1050 mV−542 mV=508 mV

Finally, using the ratio:

AP/actual current=desired shift/required current 187 mV+1.8 A=508 mV+required current Solving this equation yields 4.89 amps as the required current to use in the rectifier 26 for substation A, so a 5 amp current is used as the impressed current at this particular substation A.

12—Set rectifier 26 output to attain −1300 mV CSE (Copper-sulfate reference electrode) potential on the grounding grid 12 (aim for instant-off potential of about −850 to −1050 mV).

13—Measure the cathodic protection "on" and "instant off" potentials on selected poles to confirm that a sufficient shift in potential has been achieved. Preferably these measurements are taken at least 24 hours after the grounding grids 12 have been electrified with their corresponding rectifiers 26.

14—Consider supplementing the cathodic protection at individual poles 14 showing a potential of less than −800 mV by installing additional localized cathodic protection (such as sacrificial magnesium anodes locally at the individual poles 14). It is expected that practically 100% corrosion protection is obtained for poles 14 near substations 10. However, poles 14 located very far from substations 10 may have a limited shift in potential (in the range of 30 to 60 mV shift) and therefore only partial protection is obtained. Even with low potential shifts for poles far from the substations, this can translate into a substantial addition to the life of those galvanized poles.

Figure 4:
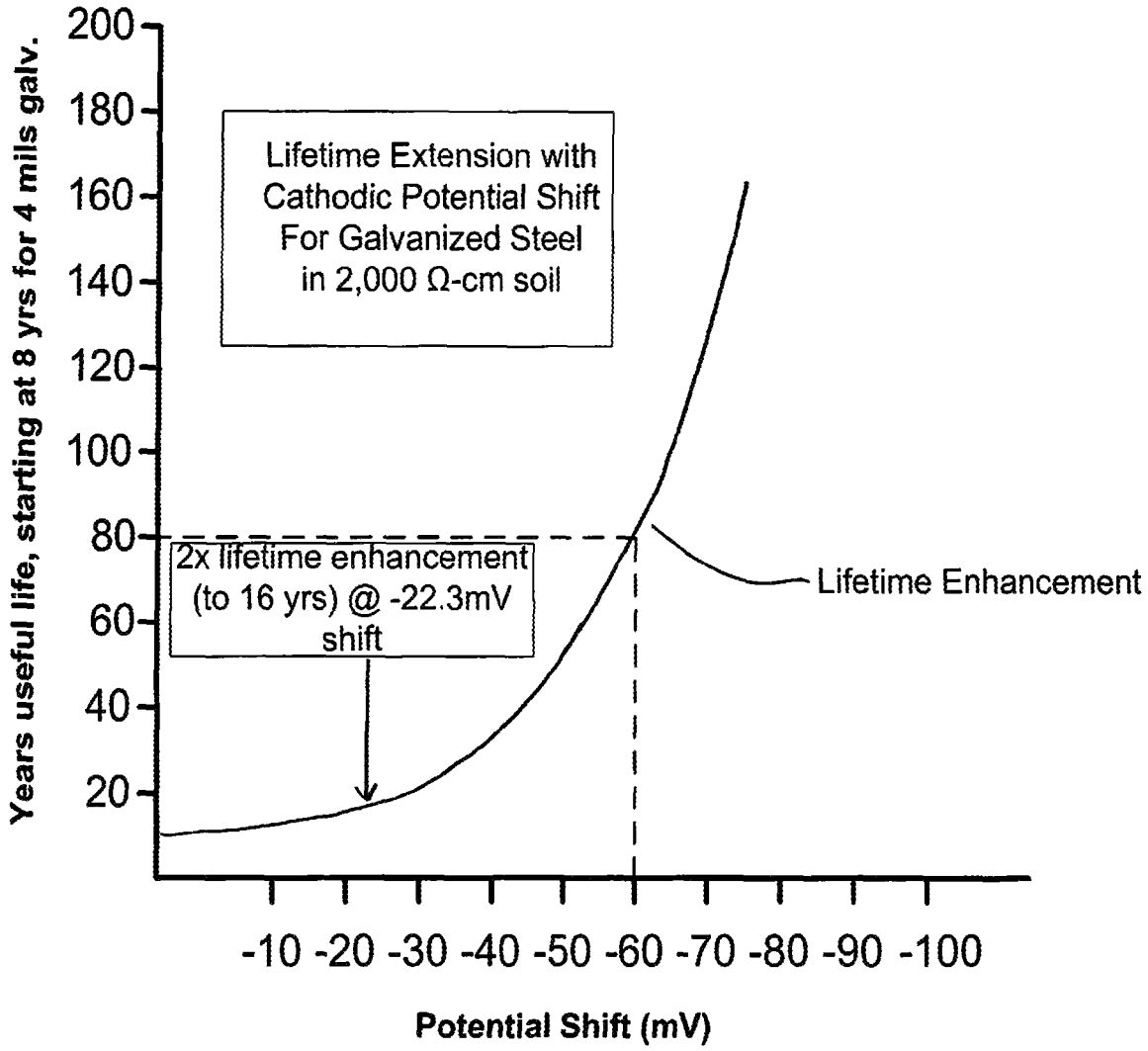
FIG. 4 is a graph showing years of useful life for a galvanized pole as a function of shift in potential

FIG. 4 is a graph showing the years of useful life for a galvanized pole or structure starting at 8 year useful life at zero shift in potential. It may be appreciated that a shift in potential of approximately −60 mV results in an 80 year useful life, an increase of one order of magnitude in the useful life of the pole.

15—Wireless transmitters may be installed to monitor data from reference electrodes measuring the electrical potential at selected poles 14 so as to detect irregularities which may signal a change in the environmental or physical conditions surrounding the pole 14 which may impact its level of cathodic protection.

The electrochemical potentials are an indication of corrosion activity and as such the data can be used to monitor the corrosion activity of the poles 14, the effectiveness of the cathodic protection, the level of protection, changes in soil corrosivity surrounding the poles 14, and irregularities in the shield line 16.

The aforementioned graph (See FIG. 4), coupled with the wireless monitoring of the electrochemical potentials at selected poles (or at all the poles) 14, may be used to estimate the remaining useful life of the poles 14.

It will be obvious to those skilled in the art that modifications may be made to the embodiment described above without departing from the scope of the present invention as claimed.

What is claimed is:

1. A method for protecting a plurality of steel electrical poles located near an electrical substation, said electrical substation being electrically grounded to a grounding grid, each of said plurality of metal electrical poles connected to said grounding grid via a common wire, said method comprising:

providing one or more impressed current anodes located at a pre-determined distance from said grounding grid; wherein the impressed current anodes are place at least on the North, South, East and West sides of the grounding grid; further wherein the impressed current anodes are placed at approximately the midpoint of each side of the grid and at an approximate distance of L/3.5 from the sides of the grounding grid where L is the length of a given side of the grid; and supplying a direct current power from a direct current power source comprising a positive terminal and a negative terminal, said positive terminal of said direct current power source being electrically connected to said one or more impressed current anodes, said negative terminal of said direct current power source being electrically connected to said grounding grid, wherein said direct current power source is configured to apply a direct current that reduces an electrical potential of said grounding grid, wherein the amount of the applied direct current depends on number of impressed current anodes.

2. The method as recited in claim 1, wherein said one or more impressed current anodes surrounds said grounding grid.

3. The method as recited in claim 1, wherein said one or more impressed current anodes are electrically connected to one another and to said direct current power source.

4. The method as recited in claim 1, further comprising:

measuring a native potential for a subset of said plurality of metal electrical poles;

determining a native potential for said grounding grid;

recording the Instant Off potential reading of said grounding grid; and adjusting said direct current power source to obtain a predetermined polarization of said ground grid to protect said plurality of metal electrical poles.

5. The method as recited in claim 4, further comprising:

measuring a cathodic protection On and Instant Off potentials of said subset of said plurality of metal electrical poles to confirm that a sufficient shift in potential has been achieved; and installing additional, localized cathodic protection at said subset of said plurality of metal electrical poles that are not sufficiently protected by adjusting the effective electrical potential of the grounding grid.

6. The method as recited in claim 1, further comprising:

providing a plurality of reference electrodes adjacent to said subset of said plurality of metal electrical poles;

measuring an electrical potential at said plurality of reference electrodes;

connecting wireless transmitters to said plurality of reference electrodes;

transmitting data comprising measured electrical potential from said plurality of reference electrodes through said wireless transmitters; and monitoring the data from said plurality of reference electrodes to detect irregularities which signal a change in conditions impacting a level of cathodic protection of said plurality of metal electrical poles.

7. The method as recited in claim 2, further comprising:

providing a current through said direct current power source to obtain a desired grid polarization to protect said plurality of metal electrical poles.

8. The method as recited in claim 3, further comprising:

providing a current through said direct current power source to obtain the desired grid polarization to protect said plurality of metal electrical poles.

9. The method as recited in claim 6, further comprising:

measuring a cathodic protection On and Instant Off potentials of said subset of said plurality of metal electrical poles to confirm that a sufficient shift in potential has been achieved; and installing additional, localized cathodic protection at said subset of said plurality of metal electrical poles that are not sufficiently protected by adjusting the effective electrical potential of the grounding grid.

* * * * *